US005461897A

United States Patent [19]

Gray et al.

[11] Patent Number: 5,461,897

[45] Date of Patent: Oct. 31, 1995

[54] U-BOLT BENDING APPARATUS

[75] Inventors: John C. Gray, Dayton, Ohio; Duane E. Shultz, Pulaski, Wis.

[73] Assignee: L & H Threaded Rods Corp., Dayton, Ohio

[21] Appl. No.: 129,672

[22] Filed: Sep. 30, 1993

[51] Int. Cl.[6] ..... B21K 1/74; B21D 7/06

[52] U.S. Cl. ..... 72/213; 72/452; 72/456

[58] Field of Search ..... 72/212, 213, 215, 72/383, 389, 447, 452, 453.12, 456

[56] References Cited

U.S. PATENT DOCUMENTS

| | | | |
|---|---|---|---|
| 2,918,101 | 12/1959 | Riker | 72/213 |
| 4,446,711 | 5/1984 | Valente | 72/213 |
| 4,696,180 | 9/1987 | Zandel | 72/456 |
| 4,936,131 | 6/1990 | Gray | 72/213 |

OTHER PUBLICATIONS

Arctic Bend 35 Cold Forming U–Bolt Bender, Turner's Manufacturing–Turner's Alignment & Brake Service, Inc., Muncie, Ind.

*Primary Examiner*—Lowell A. Larson

*Assistant Examiner*—Thomas C. Schoeffler

*Attorney, Agent, or Firm*—Jacox & Meckstroth

[57] ABSTRACT

A frame supports an interchangeable mandrel or die which receives the center portion of an elongated metal rod having opposite threaded end portions, and the rod is clamped to the die by a locking bar actuated by a hydraulic cylinder. The frame also includes a set of vertically spaced cross members connected by a pair of parallel spaced guide rods which support a carrier bar for vertical movement. The carrier bar pivotally supports corresponding end portions of a pair of arms each formed by parallel spaced plates, and each pair of plates defines slightly angled aligned cam slots. A pair of bending rollers are supported by the opposite end portions of the arms, and a hub member extends between the plates of each arm and supports rollers which engage the corresponding cam slots to provide for moving the arms and bending rollers along non-parallel converging paths for overbending the rod around the die. An elongated adjustment screw is rotatable supported by the lower cross member and extends between the plates forming the arms. The screw has oppositely threaded portions engaging the hub members to provide for convenient and precisely adjusting the spacing between the bending rollers for accommodating dies and rods of different sizes.

15 Claims, 1 Drawing Sheet

U-BOLT BENDING APPARATUS

BACKGROUND OF THE INVENTION

In the art of machines for cold bending threaded rods into U-bolts, for example, of the general type disclosed in U.S. Pat. No. 4,936,131 issued to a co-inventor of the present invention, it is common to position an unthreaded center portion of a metal rod having opposite threaded end portions onto a mandrel or die and to bend the rod around the die by moving a pair of bending rollers along parallel linear paths on opposite sides of the die. The bending rollers are usually supported by arms which form part of a movable carriage actuated by a hydraulic cylinder. The arms are adjustable by a connecting adjustment screw extending from a hand wheel or crank for adjusting the spacing between the bending rollers to accommodate dies of different sizes and shapes and also for accommodating rods of different diameters.

The bending operation is produced by extending and retracting the carriage and the bending rollers so that the metal rod is bent into a generally U-shaped configuration to form a U-bolt. While the bending rollers form the U-bolt with parallel legs having the threaded end portions, when the carriage and bending rollers are retracted, the metal rod springs back slightly so that the legs are no longer precisely parallel and diverge outwardly by a slight angle.

U-bolt bending machines have been constructed wherein the bending rollers are carried by corresponding end portions of pivotally supported arms, and the arms are backed-up by corresponding rollers. The back-up rollers cause the arms and rod bending rollers to move inwardly or converge as the bending rollers move past the die in order to obtain overbending of the rod around the die. Thus when the arms and bending rollers are retracted, the leg portions spring back to substantially parallel positions. The backup rollers have also been supported by corresponding adjustable blocks in order to adjust the slightly converging paths of the bending rollers when the carriage moves from its retracted position to its extended position. Such a bending machine, which overbends the U-bolts to obtain substantially parallel legs, has been used for high volume production of one size U-bolt since substantial down time of the bending machine is required to adjust or reset the backup roller support blocks when a different mandrel is used or different diameter rods are to be bent into U-bolts. One such U-bolt bending machine was constructed and used by Turner's Alignment and Brake Service, Inc. in Muncie, Ind. and sold under the trademark "Arctic Bend".

SUMMARY OF THE INVENTION

The present invention is directed to an improved apparatus or machine for cold bending a metal rod having opposite threaded end portions into a U-bolt having parallel legs formed by the end portions. The apparatus of the invention not only provides for overbending the rod so that the threaded legs are parallel after the bending operation, but also provides for conveniently accommodating interchangeable mandrels or dies of different shapes or sizes and also threaded rods of different lengths and diameters. The U-bolt bending apparatus or machine of the invention may also be positioned horizontally or vertically if it is desired to minimize the floor space required by the machine.

In accordance with one embodiment of the invention, a vertical frame supports an interchangeable mandrel or forming die which receives the center portion of a metal rod having threaded end portions. The frame also includes a set of vertically spaced cross members which are rigidly connected by horizontally spaced vertical guide rods, and a carriage is supported by the guide rods for vertical movement. The carriage pivotally supports a pair of depending arms which have lower end portions supporting a corresponding pair of bending rollers, and each of the roller support arms is formed by a pair of parallel spaced plates which define corresponding aligned slots within the arms.

A hub member extends through the slots within each arm and supports a pair of bearings which engage slightly angled cam surfaces defining the slots. A hydraulic cylinder is supported by the frame and has a downwardly projecting piston rod connected to the carriage for moving the arms and bending rollers vertically along slightly converging paths extending adjacent the mandrel or bending die. An adjusting screw is rotatably supported by the lower cross member of the frame and extends between the parallel plates of each arm. The screw has oppositely threaded portions engaging the hubs supporting the bearings, and hand wheels are mounted on opposite end portions of the adjusting screw. Rotation of the screw provides for conveniently adjusting the spacing between the bending rollers for accommodating threaded rods of different diameters and bending dies of different sizes and shapes while also providing for overbending of the rod around the die.

Other features and advantages of the invention will be apparent from the following description, the accompanying drawing and the appended claims.

DESCRIPTION OF THE PREFERRED EMBODIMENT

Figure 1:
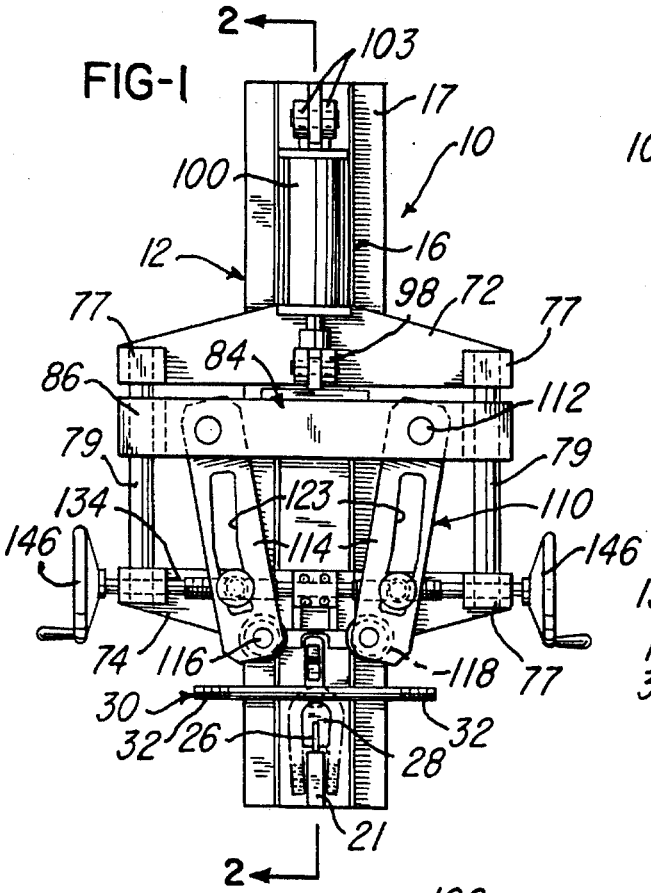
FIG. 1 is an elevational view of a U-bolt bending apparatus or machine constructed in accordance with the invention.

FIG. 1 illustrates a bending apparatus or machine 10 which includes an upright or vertical frame 12 fabricated of heavy gauge sheet metal and including a front wall 14 welded to opposite side walls 16 each having an outwardly projecting flange 17. A bar 21 projects through a slot within the bottom of the front wall 14 and is welded to the front wall and also to a cross bar 23 which is welded to the side walls 16. The bar 21 supports a plate 26 which is welded to the top of the bar 21 and the front wall 14 of the frame 12. The plate 26 defines a slot for receiving an inverted U-shaped mandrel or forming die 28 which slides downwardly into grooves formed within the sides of the plate 26. The die 28 is interchangeable with other dies of different shapes and different widths and may be replaced simply by lifting the die from the support plate 26.

Figure 2:
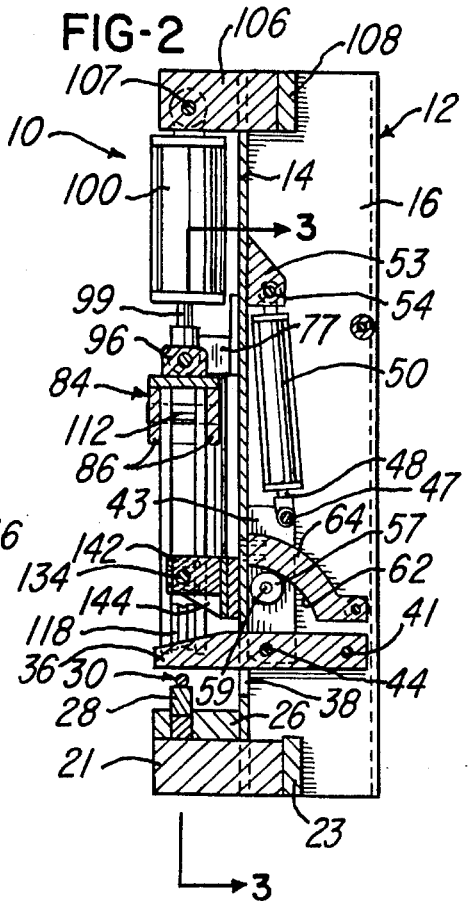
FIG. 2 is a vertical section of the bending machine, taken generally on the line 2—2 of FIG. 1.
Figure 3:
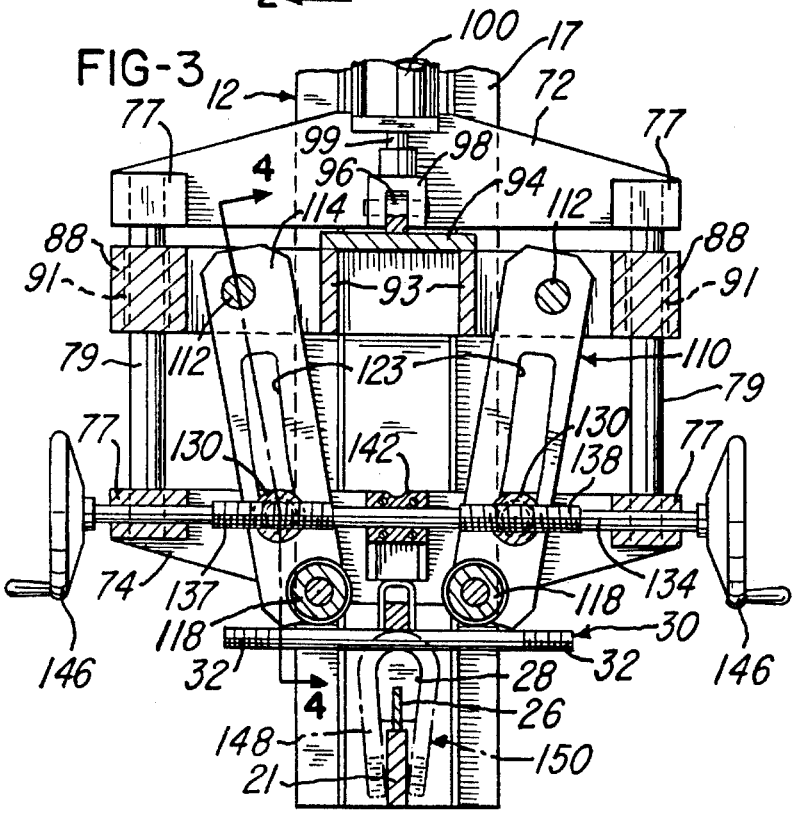
FIG. 3 is a fragmentary section of the bending machine, as taken generally on the line 3—3 of FIG. 2, and showing the overbending operation of a threaded rod into a U-bolt.

The upper part of the die 28 is adapted to receive and support the center portion of a straight cylindrical metal rod 30 having opposite threaded end portions 32. Preferably, the center portion of the rod 30 and the top portion of the die 28 are provided with corresponding marks in accordance with above mentioned U.S. Pat. No. 4,936,131 in order to provide for conveniently and quickly positioning the rod 30 on the die 28 regardless of the length of the rod 30. As shown in FIGS. 2 & 3, the center portion of the rod 30 is clamped to the die 28 by a lever arm 36 which projects through a slot 38 within the front wall 14 of the frame 12 and is pivotally supported by a cross shaft 41.

A vertical link element 43 has a lower end portion pivotally connected to the arm 36 by a cross pin 44, and the upper end portion of the link element 43 is pivotally connected by a cross pin 47 to the piston rod 48 of a hydraulic cylinder 50. A bracket 53 is welded to the wall 14 and pivotally supports the cylinder 50 by a cross pin 54. A roller 57 is supported by a cross shaft 59 connected to the link member 43, and the roller 57 engages the bottom cam service 62 of an arcuate cam member 64 rigidly secured to the frame 12.

When the piston rod 48 is extended, the link member 43 first pivots the arm 36 downwardly until the arm engages the rod 30. The link member 43 then pivots clockwise as the roller 57 engages the cam surface 62 and locks the lever 36 in its clamping position after the link member 43 has pivoted clockwise by approximately 45 degrees. In this locked position of the lever arm 36, the threaded rod 30 is rigidly secured and locked to the top center of the die 28 so that the opposite end portions of the rod 30 may be bent downwardly around the die 28.

Figure 4:
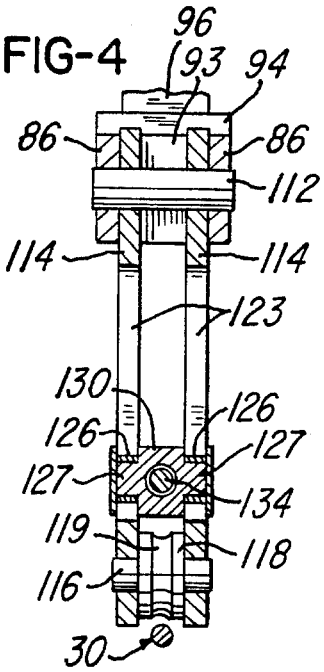
FIG. 4 is a fragmentary section taken generally on the line 4—4 of FIG. 3.

The frame 12 also includes an upper cross member 72 and a lower cross member 74 which are welded to the front wall 14. Each of the members 72 and 74 is welded to a pair of blocks 77 located at opposite end portions of each cross member, and corresponding blocks 77 are rigidly connected by parallel spaced vertical guide rods 79. The vertical guide rods 79 support a fabricated carriage 84 for vertical sliding movement. The carriage 84 includes parallel spaced cross plates 86 (FIG. 4) which are rigidly connected by end blocks 88 (FIG. 3) each retaining a sleeve-type bearing 91 for receiving the corresponding guide rod 79. A pair of vertical plates 93 extend between the parallel spaced plates 86, and a horizontal plate 94 is welded to the plates 86 and 93. A center bar 96 is welded to the plate 94 and receives an inverted U-shaped yoke member 98 which is secured to the piston rod 99 of a hydraulically actuated cylinder 100. As shown in FIGS. 1 and 2, the cylinder 100 includes a pair of parallel spaced lugs 103 which project upwardly to receive a bar 106 and a cross pin 107. The bar 106 projects through a slot within the front wall 14 of the frame 12 and is welded to a cross bar 108 which is welded to the frame 12 in the same manner as the bars 21 and 23 at the bottom of the frame.

The carriage 84 also includes a pair of arms 110 which extend between the plates 86 and have upper end portions pivotally supported by corresponding shafts 112. Each of the arms 110 is formed by a pair of parallel spaced plates 114 which have lower end portions supporting a cross shaft 116 on which is mounted a bending roller 118 having a peripherally extending groove 119. Each pair of arm plates 114 also defines a slightly bent or non-linear slot 123, and the slots 123 of each arm 110 receive corresponding bearings 126 (FIG. 4) mounted for rotation on the reduced end portions 127 of a spacer hub 130.

An adjustment screw 134 has opposite end portions which are rotatably supported by the blocks 77 projecting from the ends of the lower cross member 74. The adjustment screw 134 also has axially spaced threaded portions 137 and 138 which have reverse threads and extend through correspondingly threaded holes within the hubs 130. The center portion of the adjustment screw 134 is rotatably supported by a clamp-type bearing block 142 secured by a bracket 144 to the front wall 14 of the frame 12. A pair of crank-type hand wheels 146 are secured to opposite ends of the adjustment screw 134.

As apparent from FIG. 3, when the adjustment screw 134 is rotated in one direction or the opposite direction, the arms 110 pivot inwardly or outwardly on the shafts 112 for adjusting and precisely selecting the space between the forming or bending rollers 118. This spacing is selected according to the size of the mandrel or die 28 and the diameter of the threaded rod 30.

In operation of the bending apparatus or machine shown in FIGS. 1–4, after a threaded rod 30 is positioned on the die 28 and clamped by the locking arm 36, the hydraulic cylinder 100 is actuated to extend the piston rod 99 and move the carriage 84 and arms 110 downwardly so that the forming rollers 118 bend the rod 30 around the die 28. As a result of the cam slots 123 and the stationary hubs 130, the bending rollers 118 have converging and slightly non-linear paths as the carriage 84 moves downwardly. As a result, the rod 30 is overbent around the die 28 as illustrated in an exaggerated manner in FIG. 3 by the converging end portions or legs 148 of a U-bolt 150 shown in phantom. When the carriage 84 is retracted upwardly, and the bending rollers 118 move upwardly along diverging paths, the leg portions 148 of the U-bolt 150 spring outwardly to a parallel relationship, thereby producing a precisely formed U-bolt.

From the drawing and the above description, it is apparent that a bending apparatus or machine constructed in accordance with the present invention, provides desirable features and advantages. For example, the apparatus provides the feature of overbending a threaded rod 30 to obtain a U-bolt 150 with parallel legs 148 while also providing the feature of conveniently adjusting the spacing between the bending rollers 119 simply by rotating the adjustment screw 134 with one of the hand wheels 146. Thus the bending apparatus provides for conveniently bending rods of selective different diameters around mandrels or dies 28 of selective different sizes or shapes, as commonly required in spring shops where U-bolts of different sizes and shapes are used for attaching leaf springs to the axles of motor vehicles. The apparatus is also adapted to operate in a vertical position in the event it is desired to limit the floor space required by the apparatus.

While the form of bending apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. Apparatus for bending a straight metal rod having a center portion integrally connecting opposite threaded end portions into a U-bolt having parallel legs formed from the end portions, said apparatus comprising a frame, a forming die adapted to receive the center portion of the rod, means for clamping the rod to said forming die, a pair of arms each supporting a bending roller positioned to engage the rod, a support member pivotally supporting said arms, means secured to said frame and supporting said forming die and said support member for relative linear movement between a retracted position and an extended position, power operated means for producing said relative movement, a set of guide members positioned for moving and directing said arms and said bending rollers inwardly towards each other during said relative movement between said forming die and said support member for overbending the rod around said forming die, an adjustment screw supported for rotation and threadably connected to said guide members, said arms and said bending rollers being movable transversely relative to said screw and said guide members during said relative movement between said forming die and said support member, and means for rotating said screw for precisely adjusting the spacing between said guide members for conveniently bending rods of different diameters into U-bolts having parallel legs.

2. Apparatus as defined in claim 1 wherein each of said arms has a cam surface, a corresponding said guide member engaging said cain surface, and said adjustment screw is threadably connected with reverse threads to said guide members.

3. Apparatus as defined in claim 1 wherein each of said arms comprises a set of parallel spaced plates having corresponding cam surfaces, one of said guide members extending between said plates of each said arm and including means engaging said cam surfaces of said plates, and said adjustment screw extends between said plates of each said arm and has threaded portions engaging said guide members.

4. Apparatus as defined in claim 1 wherein said supporting means comprise parallel spaced cylindrical guide rods mounted on said frame and supporting said support member for said linear movement, and said power operated means comprise a hydraulic cylinder having a piston rod and extending between said frame and said support member for said arms.

5. Apparatus as defined in claim 1 wherein each of said arms comprises a set of parallel spaced plates having aligned slots forming cam surfaces, each of said guide members including a hub extending between said plates of one of said arms and supporting bearings engaging said cam surfaces of said plates, and said adjustment screw extends between said plates of said arms and has reverse threaded portions engaging said hubs.

6. Apparatus for bending a straight metal rod having a center portion integrally connecting opposite threaded end portions into a U-bolt having parallel legs formed from the end portions, said apparatus comprising a frame, a forming die supported by said frame and adapted to receive the center portion of the rod, a movable clamp member supported by said frame for clamping the rod to said die, a pair of support arms each supporting a bending roller positioned to engage the rod, a support member pivotally supporting said arms, means mounted on said frame and supporting said support member and said arms for linear movement between a retracted position and an extended position, a fluid operated cylinder connected to move said support member and said arms between said retracted and extended positions, a set of guide members engaging said arms and positioned for moving and directing said arms and said bending rollers inwardly towards each other along converging paths in response to movement of said support member to said extended position for overbending the rod around said die, an adjustment screw supported for rotation by said frame between said support member and said bending rollers and having threaded portions engaging said guide members for said arms, said arms and said bending rollers being movable transversely of said screw and said guide members during movement of said support member, and said threaded portions providing for precisely adjusting the spacing between said guide members in response to rotation of said screw for conveniently bending rods of different diameters into U-bolts having parallel legs.

7. Apparatus as defined in claim 6 wherein each of said arms has a cam surface, a corresponding said guide member engaging said cain surface, and said adjustment screw is threadably connected with reverse said threaded portions to said guide members.

8. Apparatus as defined in claim 6 wherein each of said arms comprises a set of parallel spaced plates having aligned cam surfaces, one of said guide members extending between said plates of each said arm and including means engaging said cam surfaces of said plates, and said adjustment screw extends between said plates of each said arm.

9. Apparatus as defined in claim 6 wherein said means supporting said support member comprise parallel spaced cylindrical guide rods secured to said frame, and said fluid operated cylinder includes a piston rod and extends between said frame and said support member for said arms.

10. Apparatus as defined in claim 6 wherein each of said arms comprises a set of parallel spaced plates having aligned slots forming cam surfaces, each of said guide members including a hub extending between said plates of one of said arms and supporting bearings engaging said cam surfaces of said plates, and said adjustment screw extends between said plates of said arms with said threaded portions engaging said hubs.

11. Apparatus for bending a straight metal rod having a center portion integrally connecting opposite threaded end portions into a U-bolt having parallel legs formed from the end portions, said apparatus comprising a frame, a forming die supported by said frame and adapted to receive the center portion of the rod, a movable clamp member supported by said frame for clamping the rod to said die, a pair of support arms each supporting a bending roller positioned to engage the rod, a support member supporting said arms for pivotal movement on corresponding pivot axes, means mounted on said frame and supporting said support member for movement between a retracted position and an extended position, a fluid operated cylinder connected to move said support member and said arms between said retracted and extended positions, a set of guide members engaging said arms between said pivot axes and said bending rollers and positioned for moving and directing said arms and said bending rollers inwardly towards each other along converging paths in response to movement of said support member to said extended position for overbending the rod around said die, a generally horizontal adjustment screw supported for rotation by said frame between said pivot axes and said bending rollers and having threaded portions engaging said guide members for said arms, said arms and said bending rollers being movable transversely of said screw and said guide members during movement of said support member, and said threaded portions providing for precisely adjusting the spacing between said guide members in response to rotation of said screw for conveniently bending rods of different diameters into U-bolts having parallel legs.

12. Apparatus as defined in claim 11 wherein each of said arms has a cam surface, a corresponding said guide member engaging said cam surface, and said adjustment screw is threadably connected with reverse said threaded portions to said guide members.

13. Apparatus as defined in claim 11 wherein each of said arms comprises a set of parallel spaced plates having aligned cam surfaces, one of said guide members extending between said plates of each said arm and including means engaging said cam surfaces of said plates, and said adjustment screw extends between said plates of each said arm.

14. Apparatus as defined in claim 11 wherein said supporting means for said support member comprise parallel spaced cylindrical guide rods secured to said frame, and said fluid operated cylinder includes a piston rod and extends between said frame and said support member for said arms.

15. Apparatus as defined in claim 11 wherein each of said arms comprises a set of parallel spaced plates having aligned slots forming cam surfaces, each of said guide members including a hub extending between said plates of one of said arms and supporting bearings engaging said cam surfaces of said plates, and said adjustment screw extends between said plates of said arms with said threaded portions engaging said hubs.

* * * * *